United States Patent [19]

Ibrahim et al.

[11] Patent Number: 4,689,981

[45] Date of Patent: Sep. 1, 1987

[54] DRAW-BENDING METHOD

[75] Inventors: Ibrahim N. Ibrahim, Cairo, Egypt; Dennis H. Sansome, Sutton Coldfield, England

[73] Assignee: National Research Development Corporation, London, England

[21] Appl. No.: 880,099

[22] Filed: Jun. 30, 1986

Related U.S. Application Data

[63] Continuation of Ser. No. 628,603, Jul. 6, 1984, abandoned.

[30] Foreign Application Priority Data

Jul. 8, 1983 [GB] United Kingdom ..... 8318577

[51] Int. Cl.[4] ..... B21D 9/05

[52] U.S. Cl. ..... 72/150; 72/710

[58] Field of Search ..... 72/54, 56, 57, 60, 149, 72/150, 320, 321, 710

[56] References Cited

U.S. PATENT DOCUMENTS

| | | | |
|---|---|---|---|
| 3,212,312 | 10/1965 | Boyd et al. | 72/60 |
| 3,828,596 | 8/1974 | Usui et al. | 72/8 |
| 3,878,720 | 4/1975 | Stange et al. | 72/310 |
| 4,292,826 | 10/1981 | Langenecker | 72/56 X |
| 4,380,917 | 4/1983 | Uchida et al. | 72/150 X |

FOREIGN PATENT DOCUMENTS

| | | | |
|---|---|---|---|
| 1147909 | 5/1963 | Fed. Rep. of Germany | 72/710 |
| 1238313 | 4/1967 | Fed. Rep. of Germany . | |
| 1279596 | 10/1968 | Fed. Rep. of Germany . | |
| 1364019 | 5/1964 | France | 72/710 |
| 569133 | 5/1945 | United Kingdom | 72/710 |
| 450610 | 11/1974 | U.S.S.R. | 72/710 |
| 458357 | 1/1975 | U.S.S.R. | 72/710 |
| 582873 | 12/1977 | U.S.S.R. | 72/710 |
| 668732 | 7/1979 | U.S.S.R. | 72/710 |
| 747555 | 7/1980 | U.S.S.R. | 72/710 |

*Primary Examiner*—E. Michael Combs

*Attorney, Agent, or Firm*—Cushman, Darby & Cushman

[57] ABSTRACT

Apparatus for draw-bending metal tubes and other elongated workpieces of hollow section, in which a mandrel, supported on a bar within the tube, bears against the inner wall of the tube in the region of the bend and helps to prevent the tube section from collapsing or distorting. Vibration transducers are attached to the bar to set up a standing wave of resonant vibration within the mandrel and bar which has the effect of reducing friction between the mandrel and the tube. A special coupling device may be used to attach the transducers to the bar and may also serve to connect the bar to the fixed structure of the apparatus, and the invention includes the complete apparatus when tuned so as to generate a displacement antinode of vibration at the mandrel tip, a displacement node at the point of attachment of the coupling device to the structure, and generally so as to minimize waste of the vibratory energy.

1 Claim, 5 Drawing Figures

"PRIOR ART"

DRAW-BENDING METHOD

This is a continuation of application Ser. No. 628,603, filed July 6, 1984, which was abandoned upon the filing hereof.

This invention relates to the draw-bending of tubes and other elongated workpieces of hollow section.

There are several methods of bending tubes, of which the rotary draw-bending process is one of the most commonly used. An important advantage of draw-bending is that thin-walled tubes can be bent to desired radii smoothly and accurately. Such bends are in great demand for many applications in chemical engineering and in the aircraft, nuclear power and other technologically-advanced industries. FIG. 1 of the accompanying drawings is a diagrammatic section through part of a conventional draw-bending machine and shows a tube 1, the forward end 2 of which is gripped by jaws 3, 4 which form part of a framework 5 which also includes a bend former 6 and which is mounted to rotate about an axle 7. On the upstream side of former 6 the unbent part of tube 1 (terminating at rearward end 8) is supported coaxial with an axis 9 by structure including slider 10 to one side, and a fixed tool 11 known as a wiper die to the other: the front end of tool 11 is shaped so as to complement the circumference of former 6 and so leave the wall of tube 1 unsupported for the very minimum of space as it passes from contact with die 11 into contact with former 6. The broken lines 5' show framework 5 in the position it occupies when jaws 3, 4 first grip the forward end 2 of tube 1 before bending begins. The full lines show all items as they are when the tube has been drawn into a right-angled bend. Before bending begins a mandrel 13 mounted on a bar 14 is inserted into the tube through the rearward end 8, after which the bar 14 is anchored to the fixed structure of the apparatus as shown diagrammatically at 15. Then, when former 6 is rotated counter-clockwise by axle 7 which is driven by a motor indicated at 16, jaws 3 and 4 draw the forward end 2 of the tube with them around former 6 so that a bend 17 is formed in the tube. The tube wall 18 on the inside of this bend is supported by and rotates with the former 6, and in the vital early stages of the bending operation the cross-section of the tube is supported against collapse by contact between a shaped nose 19 of mandrel 13 and the part 20 of the tube wall that lies on the outside of the bend. To reduce friction, slider 10 advances with the tube as the latter is bent, so that there is no relative motion between the slider and the tube.

In an ideal bend there is no flattening or buckling of the tube section, and no thinning or thickening of the tube wall on the outside 20 and inside 18 of the bend respectively. This ideal is obviously not attained in practice, however, because the wall of the tube on the outside 20 of the bend is stretched under tension and so becomes thinned while the wall on the inside 18 of the bend shortens under compression and therefore tends to thicken. Of these two the thinning of the outer wall is in practice usually the greater disadvantage, because it is usually desirable that the strength of a tube where it is bent should be comparable with the strength of the unbent parts of the same tube. While thickening of the wall of the tube on the inside of the bend is unlikely to diminish its strength and may even improve it, thinning of the wall on the outside of the bend frequently leads to a reduction in strength.

The tension that causes such thinning is a function of the pulling force exerted upon the tube by the jaws 3 and 4, and this force is of course related to the frictional forces that must be overcome in order for the tube to respond to the pull. Prominent among these is the force generated by the friction due to the contact between the moving inner wall of the tube 1 and the surface of the stationary mandrel 13. Many different techniques have already been developed in order to reduce such friction; for example high quality lubricants have been used to lubricate the bore of the tube and so reduce the coefficient of friction, and low-friction layers have been coated upon mandrel surfaces. Such techniques are not without practical disadvantages however: suitable lubricants often contain substances—for instance, chlorine—which are unsuitable when draw-bending certain materials because they will corrode and damage them, and a manufacturer who decides to use coated mandrels must be prepared to coat a very large number of different sizes in order to provide the wide product range of tube diameters and wall thicknesses that the trade expects tube manufacturers to be able to supply.

Some proposals to use vibratory techniques to improve drawbending processes have also been made, but these proposals have had little in common other than the use of some form of vibration. For example the specification of U.S. Pat. No. 3,878,720 includes a proposal to apply ultrasonic vibratory energy to the complementary, semi-circular halves of a guide die assembly which bears externally upon a tubular workpiece in the course of a draw-bending operation. The mode of the vibrations that the halves undergo in response is not stated. There have also been published proposals to apply axial vibrations of considerable amplitude (within a stated range of one-eighth inch to one inch) and of low frequency (from a single cycle to five hundred cycles per minute) to an internal ball type mandrel while drawing tube over it, the claimed advantages for such vibrations being specially applicable to the ball-type mandrel construction. Such dimensions of amplitude and frequency plainly suggest bodily movement of the mandrel and its supporting members, and thus the complications that naturally ensue from having to mount these parts movably upon the fixed structure of the apparatus.

The present invention arises from appreciating that the specific objective of achieving a substantial reduction in the friction between an anchored mandrel—that is to say one not capable of bodily axial movement—and the inner wall of a tubular workpiece is capable of being achieved by setting that mandrel and its supporting members into resonant vibration in an axial mode, particularly at an ultrasonic frequency. According to the invention apparatus for draw-bending an elongated workpiece of hollow section includes a bend former, support means to contact the outer surface of the workpiece and so define an axis of movement for the workpiece upstream of the former, drawing means adapted to grip the forward end of the workpiece and draw it around the former in a direction inclined to the support means axis, and an elongated mandrel assembly anchored to the fixed structure of the apparatus, the assembly having a mandrel at its free end and being located so that the mandrel lies within the workpiece close to the former to provide support for the inner wall of the workpiece as bending begins, and in which vibration transducers are attached to the mandrel assembly to set up within it a standing wave of resonant vibtation. Preferably the mandrel assembly comprises the mandrel mounted at one end of a supporting bar, the mandrel and bar are located coaxial with the support means, and the vibration transducers are adapted to set up a standing wave of vibration in an axial mode.

The transducers, bar and mandrel may be tuned so that the waveform of the vibration is such that there is a displacement antinode at the mandrel tip, and so that the total length of the mandrel and bar equals a whole number of half-wavelengths of the standing wave vibration. The transducers may also be attached to the bar by means of an intermediate coupling device, itself equal in length to a whole number of half-wavelengths of the standing wave vibration, and the intermediate member may provide the means of connection between the mandrel and bar and the fixed structure of the apparatus, these means being located at a displacement node of the standing wave vibration.

The transducers may set up a standing wave of axial vibration at an ultrasonic frequency.

There may also be means to monitor and compare the phase relationship between an AC load current indicative of the load exerted by the drawing means and a reference voltage at the output of the AC supply to the vibration transducers so as to detect any change of phase angle between these two, and means to generate a feedback signal in response to a change in phase angle and apply it to a frequency control device associated with the AC supply whereby to restore the phase angle.

Vibration transducers may also be connected to at least part of the support means—for instance the wiper die 11—to cause it to vibrate in a mode comparable to that of the mandrel.

The invention also includes a method of draw-bending using apparatus as just described.

Figure 4:
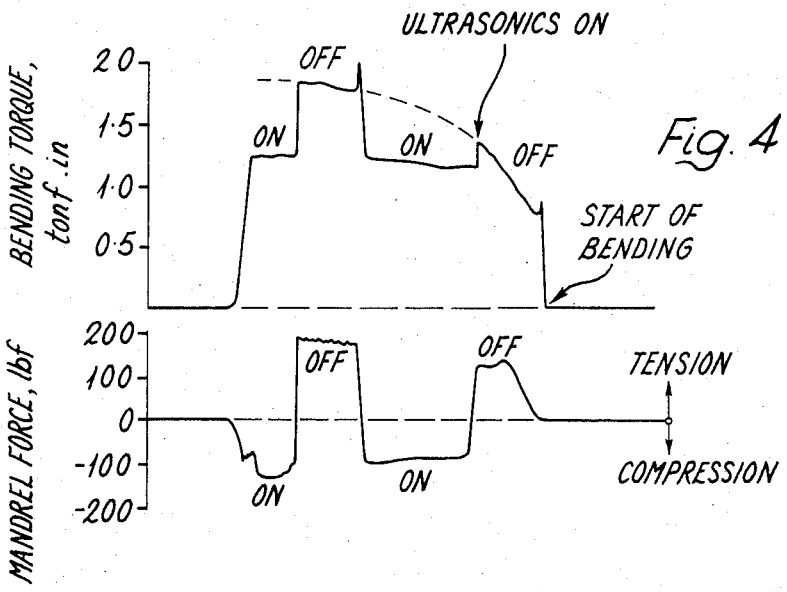

The invention is also defined by the claims at the end of this specification and will now be described by way of example, with reference to the further accompanying drawings in which:

FIG. 4 comprises two graphs, and

Figure 5:
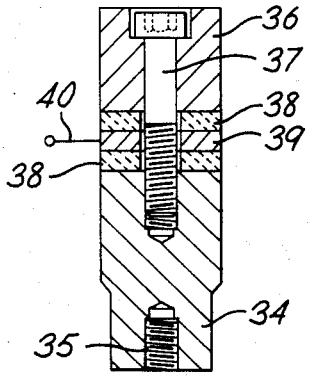

FIG. 5 is a section through one of the vibration transducers.

Figure 1:
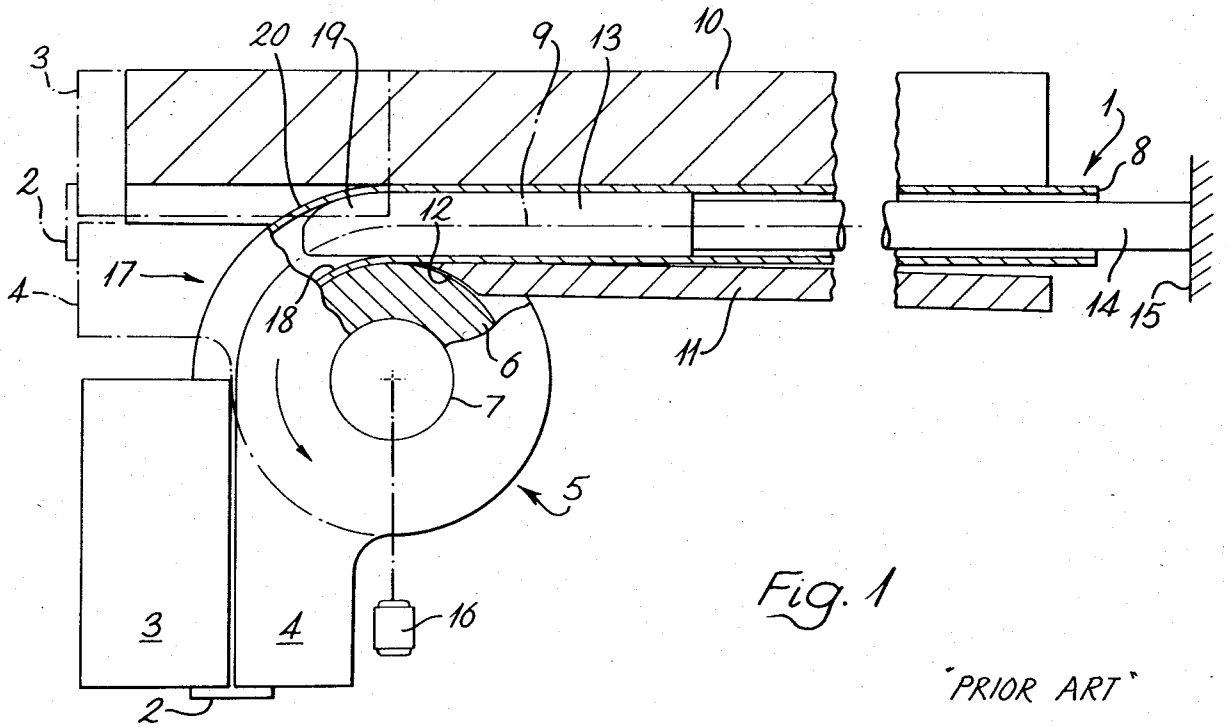
FIG. 1 is a diagrammatic, partially sectional view of a conventional draw-bending machine.
Figure 2:
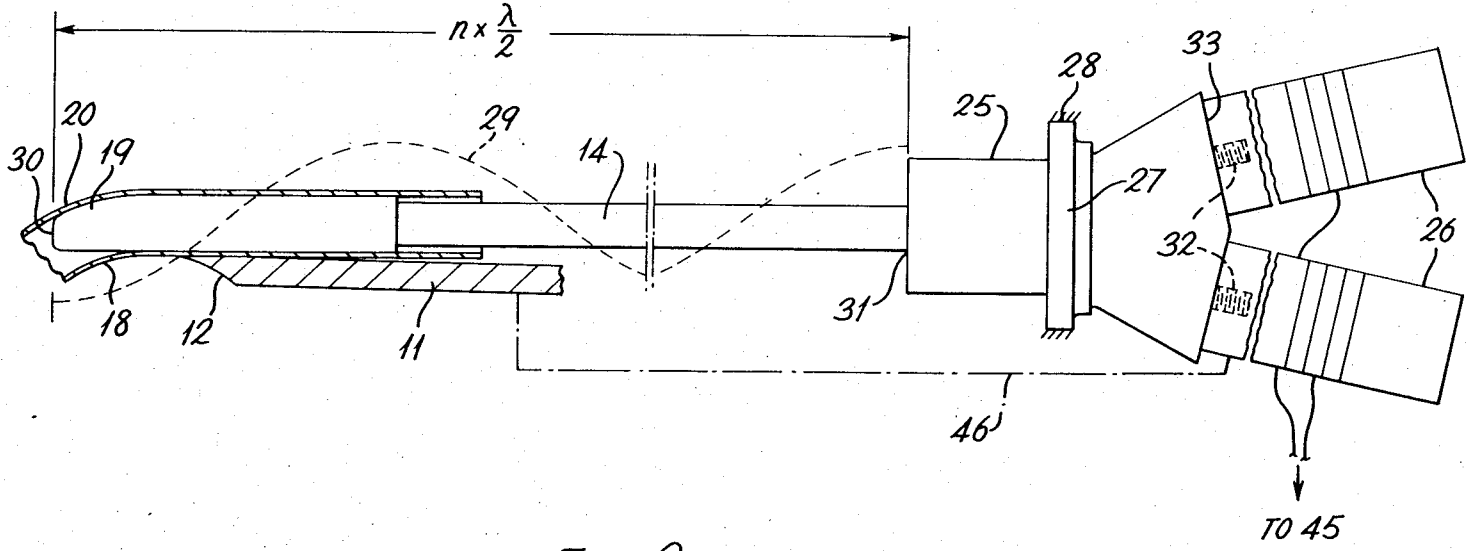
FIG. 2 is a diagrammatic view, partly in elevation and partly in axial section, through a mandrel, bar and attached vibrating mechanism.

The mandrels 13 of FIGS. 1 and 2 are exactly the same. However the attached bar 14 of FIG. 2, instead of being directly attached to the fixed structure 15 as shown in FIG. 1, is attached to a vibratory coupling horn 25. Three vibration transducers 26 are attached to the opposite end of the horn, and midway along its axial length the horn presents a flange 27 by which the whole assembly of transducers, born bar and mandrel is anchored to fixed structure as indicated diagrammatically at 28. In use the assembly is tuned, in a manner to be described, so as to set up within the bar and mandrel a standing wave of axial vibration the amplitude of which is represented graphically by waveform 29. In order for this to be achieved the total axial length of the mandrel and bar, from the extreme free end 30 of the mandrel to the point 31 where the bar 14 meets the horn 25, must equal a whole number of half-wavelengths of the standing vibration, so that displacmeent antinodes of the vibration occur both at 30 and 31. Since in practice any effective standing wave is likely to extend also to the horn 25, it is a practical necessity that the axial length of the horn also should be equal to a whole number of half-wavelengths, and in FIG. 2 it is a single half-wavelength long. To avoid wasteful transmission of vibratory energy to the fixed structure of the apparatus, flange 27 is located at a displacement node of the vibration.

Three transducers 26 are mounted in axisymmetric arrangement on threaded studs 32 projecting from the angled rear end face 33 of horn 25. While many other designs of transducer, for instance of magnetostrictive type, would be suitable, the transducers shown in FIGS. 2 and 5 comprise an aluminium output end section 34 threaded at 35 to receive studs 32, and a stainless steel rear end section 36. Sections 34 and 36 are held together by a bolt 37 clamping between them a three-layer sandwich comprising outer layers 38 of piezo-ceramic crystal and an inner conducting layer 39 connected to a live terminal 40.

Figure 3:
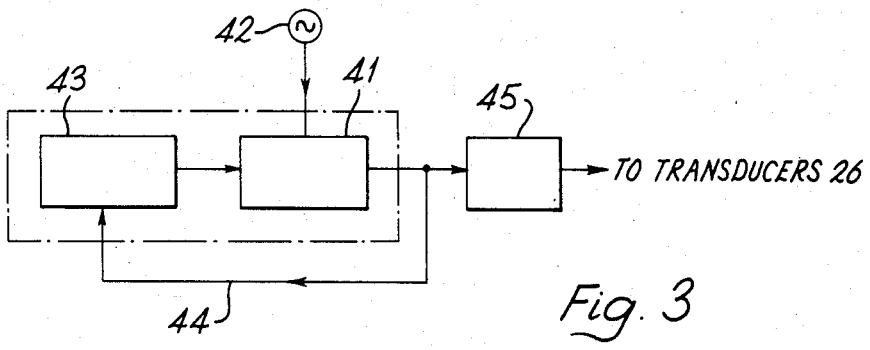
FIG. 3 is a schematic layout of the electrical system.

As FIG. 3 shows, the live terminals 40 of the three transducers 26 are connected to a suitable power generator 41 (for instance the model ERG-3200 sold by ENI Power Systems Ltd) which is itself connected to a single-phase 240-volt AC supply 42. Generator 41 essentially comprises a solid-state broad-band amplifier driven by an internal oscillator, by which the operating frequency is determined by the frequency setting of the oscillator and the output power is dependent solely on the gain setting of the amplifier. The model just specified gives a convenient output rating of 3000 W over a frequency range of 14–70 kHz.

Normally during a bending operation the resonant fequency of the parts of the system subject to the vibratory standing wave—that is to say the mandrel 13, bar 14 and horn 25—changes due to load variations which affect the stiffness mass and density of these parts and also due to heating effects which may alter their elastic properties. Therefore unless the generator 41 is made to follow any such change of frequency quickly and accurately, the load impedance will become mismatched with the generator and as a result the load power will diminish. In order to avoid this the electrical system includes a frequency controller 43 and a feedback signal loop 44, which continuously monitor the phase relationship between the load current and a reference voltage existing at the output of the oscillator stage of generator 41. For resonance to occur and thus for an optimum amount of load power to be delivered, there should be no phase shift between the output current and the voltage. However, when the load frequency varies in relation to the frequency of generator 41, the phase angle between the current and the voltage changes also. This change in the phase angle is used to generate a feedback DC signal which is applied to the frequency of generator 41 to match that of the load. Because the electrical matching between generator 41 and the load is of prime importance, the electrical system also includes a matching circuit 45 typically comprising an in-series inductance which cancels out the capacitance of the transducers 26 and transforms their resistive load impedance to a value which matches the output of generator 41. When generator 41 is of type EGR 3200 as already mentioned, model EVV-2 as sold by ENI Power Systems Ltd is suitable for use as matching circuit 45.

Transducers 26 were designed to set up a standing wave in components 13 - 14 - 25 at a resonant frequency of 20 kHz. In tests with apparatus as described, thin-walled mild steel tubes of one inch outside diameter (d) and of different thickness dimensions (t), so that the diameter-to-thickness ratio d/t varied in the range from 16 to 28, were bent at a constant bending speed of 10 rev $min^{-1}$ with and without 20 kHz axial vibrations being applied to the mandrel and bar. The mean bend radius (R) varied from 1.5 to 2.5 d, the ultrasonic power input to transducers 26 was of the order of 1,000 watt or less, and the maximum value of the amplitude of the axial vibration occurring at the antinodes was of the order of $6\times10^{-4}$ in, and was thus very small compared with such dimensions as the diameter of the tube or the radius of the bend.

FIG. 4 shows an example of typical ultra-violet recorder traces obtained from the tests, and from these it can be seen that both the bending torque and the force exerted by the mandrel upon the tube drop abruptly when generator 41 is energised, only to increase immediately to a high level when the power is switched off. The part of FIG. 4 relating to bending torque shows that while the non-oscillatory torque (broken line) increases continuously, the oscillatory curve is almost flat. Furthermore the applied vibrations can be seen to cause the mandrel force to reverse from tension to compression, so that when the power is on the motion of the mandrel assists the motion of the tube instead of resisting it, which is usually in non-oscillatory bending.

The mechanics of metal deformation during the proces of the draw-bending of tubes comprise two successive stages. First the tube is pulled over the parallel-sided part of the shank of mandrel 13, while being supported from the outside by slider 10 and (close to the former 6) by the tip of the wiper die 11. During this stage the friction at the tube-mandrel interface (and also to some extent at the interface between the tube and the stationary wiper die) causes an induced tensile stress in the longitudinal direction. In the second stage each tube element is bent to the specified mean bend radius and is pulled over the nose 19 of mandrel 13 and around the former 6. During this stage the tube is plastically deformed by bending, but in addition strains are induced in the tube as a result of friction between the inner surface of the tube and the nose 19. Thus the total work done to draw-bend the tube consists of two parts, namely a first deformation part comprising the work needed to deform the tube plastically in the absence of friction, and a second part required to overcome friction, principally the friction between the tube bore and the mandrel 13. To perform the second, frictional part of this work requires higher bending forces and torque than would otherwise be necessary, and results in more straining of the tube wall on the outside of the bend and therefore greater thinning of the tube wall at this location. When the mandrel is axially oscillated as already described, it is believed that the second, frictional part of the necessary work is diminished not only by reducing the coeffiecint of the friction between the mandrel and the tube but also by what may be described as reversal of the friction vector. It is believed that reductions in friction coefficient when the mandrel is oscillated may be due to the motion helping to pump lubricant into the interface between the mandrel and the tube, to the relative motion softening or melting asperities on the inner wall of the tube, and to the energy dissipated in the cyclic relative motion of the contacting surfaces producing some rise in temperature and a reduction in the shear yield stress of the tube asperities. The nature of friction vector reversal may be explained by appreciating that when a mandrel is stationary and a tube moves slowly over it the friction acting in the conventional direction, always opposes the motion of the tube. When however the mandrel is vibrated axially the resultant vector of the velocity (relative to the mandrel) of any point on the tube surface changes direction during each cycle of oscillation, During that part of that cycle when the oscillatory velocity is in the forward direction and has a value greater than that of the forward velocity of the tube, the resultant vector is in the direction opposite to that of the motion of the tube. Therefore the frictional force then acts in the same direction as that in which the jaws 3 and 4 are tending to pull the tube, and so assists the bending process. During the rest of each cycle the mandrel moves backwards and the resultant vector is in the same direction as the motion of the tube. During this part of the cycle therefore the frictional force opposes the bending process, but it does so no more strongly than it would if the mandrel 13 were stationary because the frictional force equals the product of the coefficient of friction and the normal reaction between the parts in contact, and the coefficient of friction is actually less than what it would be if the mandrel were stationary, for the reasons already stated.

The invention also includes draw-bending apparatus in which the vibration generators apply vibrations not only to the mandrel but also to other structures in contact with the tube upstream of the former. For instance to the wiper die 11: a diagrammatic connection 46 between die 11 and transducer 26 is shown in FIG. 2.

We claim:

1. A method of draw-bending an elongated workpiece of hollow section with apparatus including a bend former, support means to contact the outer surface of the workpiece, drawing means for gripping the workpiece and drawing the workpiece in a bend around the former and an elongated mandrel assembly having one end anchored to a fixed structure of the apparatus and presenting at an end opposite said one end a mandrel means for disposition within the workpiece close to said bend former, said mandrel means including a forward nose part presenting a surface which faces generally radially outward relative to a bend to be formed in the workpiece, said appartus further including first vibration transducers attached to said mandrel assembly, the steps comprising:

gripping a portion of the workpiece with the drawing means and imparting movement to said drawing means to effect bending of the workpiece over the bend former, while disposing the nose part of the mandrel within the workpiece in sliding and supporting contact with the inner surface of that part of the wall of the workpiece lying on the outside of the bend being formed;

supporting the outer surface of the workpiece to define a first axis of drawing movement for the workpiece upstream of the bend former with said drawing means being disposed downstream of the bend former, said drawing means moving by virtue of said movement to a position in which said workpiece gripped by said means defines a second axis of drawing movement extending at an angle to said first axis;

imposing on said workpiece a standing wave of resonant vibration with the first vibration transducers, the standing wave extending in a direction aligned with said first axis of drawing movement and out of alignment with said second axis and with the first vibration transducers and said workpiece being without direct attachment therebetween; and continuing said movement of said drawing means without substantially changing the cross-section of said workpiece as bending of said workpiece is accomplished.

* * * * *